US006043462A

United States Patent [19]

Stedron et al.

[11] Patent Number: 6,043,462

[45] Date of Patent: Mar. 28, 2000

[54] MOUNTING ARRANGEMENT FOR COOKING SURFACE AND METHOD OF MOUNTING COOKING SURFACE

[75] Inventors: Horst Stedron, Herborn; Peter Nass, Mainz; Ulrike Bader, Stuttgart; Bernd Schultheis, Schwabenheim, all of Germany

[73] Assignees: Schott Glas, Mainz, Germany; LKH Kunststoffwerk GmbH & Co., Haiger, Germany

[21] Appl. No.: 09/147,868

[22] PCT Filed: Aug. 18, 1997

[86] PCT No.: PCT/EP97/04506

§ 371 Date: May 18, 1999

§ 102(e) Date: May 18, 1999

[87] PCT Pub. No.: WO98/12481

PCT Pub. Date: Mar. 26, 1998

[30] Foreign Application Priority Data

Sep. 17, 1996 [DE] Germany ..... 196 37 896

[51] Int. Cl.[7] ..... H05B 3/68; F24C 15/10

[52] U.S. Cl. ..... 219/452.11; 219/452.12; 126/211

[58] Field of Search ..... 219/451.1, 452.11, 219/452.12, 460.1, 461.1, 465.1; 126/211, 217, 218, 214 A

[56] References Cited

U.S. PATENT DOCUMENTS

| | | | |
|---|---|---|---|
| 3,632,983 | 1/1972 | Dills | 219/452.12 |
| 3,866,018 | 2/1975 | Hurko | 219/452.12 |
| 3,870,862 | 3/1975 | Doner | 219/452.12 |
| 4,363,956 | 12/1982 | Scheidler et al. | 219/452.11 |
| 4,608,962 | 9/1986 | Ng | 219/452.12 |
| 5,844,206 | 12/1998 | Steiner et al. | 219/452.11 |

FOREIGN PATENT DOCUMENTS

| | | |
|---|---|---|
| 2142 692 | 8/1971 | Germany . |
| 24 07 582 A1 | 8/1975 | Germany . |
| 29 15 529 A1 | 11/1980 | Germany . |
| 2 021 909 | 12/1979 | United Kingdom . |

*Primary Examiner*—Sang Paik

*Attorney, Agent, or Firm*—Jansson, Shupe, Bridge & Munger, Ltd.

[57] ABSTRACT

A mounting arrangement for a cooking surface is mounted in a cut-out of a work plate, such as in a kitchen range top, with the aid of a frame unit having a supporting section on which the mounting arrangement is supported. The mounting arrangement also includes functional elements which support electronic built-in elements, such as heating elements, cables or similar. The electronic built-in elements can be easily mounted with few parts by molding an assembly unit and the frame unit into a one-piece assembly having separatable areas. The assembly unit has a tub-shaped base body and the assembly unit includes a floor unit. The functional elements are at least partially molded into the assembly unit.

14 Claims, 2 Drawing Sheets

MOUNTING ARRANGEMENT FOR COOKING SURFACE AND METHOD OF MOUNTING COOKING SURFACE

RELATED APPLICATION AND CLAIM OF PRIORITY

This application is a national application of PCT Application No. PCT/EP97/04506 having an international filing date of Aug. 18, 1997, which designates at least one country in addition to the United States and which claims priority from German Application No. 196 37 896.6 filed Sep. 17, 1996. For priority purposes, this application continues the above-noted PCT application and claims the benefit of 35 USC 371 and/or 35 USC 120.

BACKGROUND OF THE INVENTION

1. Field of the Invention

The present invention generally relates to a mounting arrangement for and method of mounting a cooking surface and more particularly, to a mounting arrangement for and method of mounting a cooking surface, wherein the cooking surface is to be installed in a cut-out in a work plate by using a frame unit which includes a support section on which the cooking surface is to be supported, wherein the frame unit and an assembly unit, which has a tub-shaped base body, are integrally molded to each other as a one-piece structure including separatable areas, and wherein the assembly unit includes functional elements for supporting built-in electronic components, such as heating elements, cables or similar.

2. Description of the Related Art

A conventional mounting arrangement is taught in GB 2021909 (hereinafter GB '909). The mounting arrangement taught in GB '909 is for supporting a cooking surface to be installed in a cut-out of a work plate. The mounting arrangement includes a frame unit having a support section. The cooking surface is placed on this support section. The cooking surface can be fixed to the support section via a silicone adhesive. The mounting arrangement also includes an assembly unit which is integrally molded to the frame unit to form a one-piece structure. The assembly unit has a tub-shaped base body that is arranged beneath the cooking surface. The one-piece structure of the frame unit and the assembly unit is produced from a sheet steel blank in a deep drawing process. The tub-shaped base body of the assembly unit is provided with a plurality of perforations. These perforations can be closed off with the aid of individual plate elements. The plate elements are screwed into the tub-shaped base body of the assembly unit. A spring holder is riveted to the plate elements for fixing heating elements thereto. The spring holder supports the heating elements and presses the heating elements, within the tub-shaped base body of the assembly unit, to the underside of the cooking surface. The attachment of the plate elements to the tub-shaped base body of the assembly unit requires considerable parts and assembly costs. In addition, the free edges of the plate element and the perforation closed by the plate element need to be filed, smoothed or de-burred in order to prevent injury.

DE 29 15 529 teaches a mounting arrangement for a cooking surface that essentially corresponds to the cooking surface taught in GB '909.

DE 24 07 582 teaches a mounting arrangement for a cooking surface that includes a frame unit with a support section. A cooking surface can be fastened onto the support section. The frame unit itself is composed of two frame parts. A circumscribing suspension clip can be fastened on the frame unit assembled from the two frame parts. The circumscribing suspension clip serves to connect a floor group. The floor group is arranged so as to be parallel to and at a distance from the cooking surface. Electrical components, such as heating elements, can be fixed to the floor group. A plurality of individual parts are required to construct such a mounting arrangement and thus, commercial manufacture is only possible with difficulty.

DE 21 42 692 (hereinafter DE '692) teaches another known mounting arrangement for a cooking surface. The mounting arrangement taught in DE '692 has a frame unit that is assembled from four individual profile sections. The profile sections are connected to each other at the corner areas of the frame unit using corner connectors. The profile sections include a U-shaped receiving section that surrounds the edge of the cooking surface in order to receive the cooking surface. The mounting arrangement taught in DE '692 is assembled by first sliding the profile sections onto the edge of the cooking surface. Then, the profile sections can be connected to each other with the corner connectors. A floor group is arranged beneath the cooking surface. The floor group serves to receive and fix the heating elements that are arranged under the cooking surface.

An object of the present invention is to provide a mounting apparatus for a cooking surface, wherein the cooking surface is to be installed in a cut-out of a work plate using a frame unit having a support section on which the cooking surface is supported, wherein the frame and an assembly unit, having a tub-shaped base body, are originally integrally molded into a one-piece structure with separatable areas therein, wherein the assembly unit includes functional elements for supporting electronic built-in components, such as heating elements, cables or similar, in order to securely attach the electronic components with as little cost for parts and assembly as possible.

The above-described object of the present invention is accomplished by providing the assembly unit, having the tub-shaped base body, and the floor group as an originally, integrally molded one-piece structure that has functional elements which are as least partially molded on the floor group.

The frame unit and assembly unit can then be produced as a single component with as little expense for parts and assembly as possible. Additionally, re-touching work is reduced, since the number of free edges is minimized, and a filing, smoothing or de-burring process need only take place on the edges of the frame unit near the work plate. The functional elements can then be selected, as desired, to fix the electronic components. For example, it is possible to support the heating elements so that they are optimized for stability. Individual functional elements can also perform two or more functions. For example, a functional element can support a heating element and at the same time serve as a connection point for a cable.

SUMMARY OF THE INVENTION

According to an advantageous design of the present invention of a mounting arrangement for a cooking surface, the frame unit and the assembly unit are made of either a plastic or a plastic composite material. With this selection of material, the mounting arrangement may be of a complex design, yet not be costly. The mounting arrangement can be manufactured by various processes. For example, the mounting arrangement can be manufactured by a hot press procedure or by injection molding. The material used must be scratch-proof, resistant to fading and chemicals, and insensitive to temperatures.

A possible variation of the above-described embodiment of the present invention of a mounting arrangement for a cooking surface has the functional elements supporting heating elements arranged beneath the cooking surface so as to hold the heating elements spaced from the frame unit and the assembly unit. A heat-absorbing or heat-reflecting intermediate element is arranged in the intermediate space formed between the heating element and the one-piece structure of the assembly unit and the frame unit. Because the functional elements provide the space for the heating elements, the thermal load on the mounting arrangement is reduced. A further reduction can be achieved via the intermediate element. If a heat reflecting intermediate element is selected, then the heat energy radiated to the mounting arrangement can be supplied to the cooking surface and heat loss is thereby reduced.

The functional elements have receptacles for springs, and the springs press the heating elements to the underside of the cooking surface to fix the heating elements thereto. The number of springs and the dimension of the springs can be selected depending on the desired application pressure. The functional elements may be positioned and aligned as deemed appropriate.

If the floor group is connected to the assembly unit via separatable areas so that the floor group can be removed from the assembly unit, then the floor group can later be separated from the mounting arrangement which was originally manufactured as a one-piece structure. This, above all, is advantageous, if the cooking surface is permanently connected to the mounting arrangement. For repair purposes, the floor group can be subdivided so that the appropriate repair work can be carried out. The separatable areas can hereby be built solidly, so that no weakness of any significance can arise. However, it is also possible to build the separatable areas in a manner similar to a film hinge, in which case, punching of the floor group can take place right at the time of manufacture of the mounting arrangement. In order to be able to re-connect the floor group to the mounting arrangement, the fastening receptacles must be attached to the assembly unit and to the floor group. Then, the connectors can be attached thereon. The fastening receptacles can be integrally molded along with the mounting arrangement. Then, only the connectors need be built as a separate part.

A preferred design of the present invention of a mounting arrangement for a cooking surface has the assembly unit transition into a horizontal support section for the frame via an upwardly directed circumscribing wall. The support section is supported in an outward direction by a countersurface of the work plate. With a mounting arrangement thus-configured, a filing, smoothing or de-burring procedure need take place during the manufacture only on the free end of the support section.

The frame unit is adhered to the work plate and the cooking surface is adhered to the frame unit in order to attach the cooking surface to the mounting arrangement or to attach the mounting arrangement to the work plate. Then, the adhesion material can also serve a sealing function. Foam adhesive bands or silicone adhesive may be used at the connection points.

BRIEF DESCRIPTION OF THE DRAWING FIGURES

The present invention is explained in more detail in the following on the basis of the exemplified embodiments illustrated in the drawing figures.

DETAILED DESCRIPTION OF THE INVENTION

Figure 1:
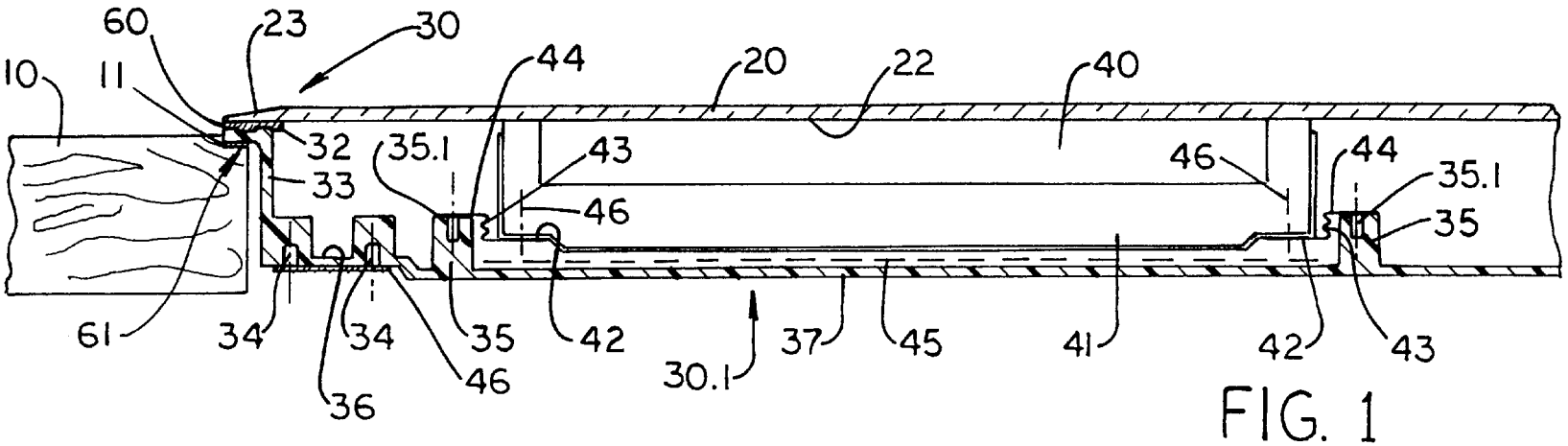
FIG. 1 is a lateral, cross-sectional view of a mounting arrangement for a cooking surface to be installed in a cut-out in a work plate.

Referring to FIG. 1, a work plate 10 is shown which includes a cut-out. An outer edge bordering the cut-out of the work plate 10 is notched or recessed to form a receptacle 11 for supporting a portion of a mounting arrangement. The mounting arrangement is made up of a frame unit 30 and an assembly unit 30.1.

The frame unit 30 includes a horizontal support section 23. The horizontal support section 23 is supported on the receptacle 11. An adhesive layer 61 is applied to the receptacle 11 under the support section 23 in order to fix the mounting arrangement to the work plate 10. A cooking surface 20 is supported on the support section 23. The cooking surface 20 is attached to the support section 23 via a holding means 32. In the preferred embodiment, the holding means 32 is a silicone adhesive. However, the holding means 32 may also be catch projections formed on the support section 23, in which case the catch projections would overlap the edge of the cooking surface 20.

A circumscribing wall 33 is connected to the support section 23. The circumscribing wall 33 is a part of the assembly unit 30.1. The circumscribing wall 33 is connected to the floor group 37 via a separatable area 36. The floor group 37, the circumscribing wall 33, and the frame unit 30 are connected to each other to form a one-piece structure. The floor group 37 is connected to the circumscribing wall 33 via a separatable area 36. The separatable area 36 may take the form of a thinned area or a circumscribing area of weakness. The mounting arrangement which is built in this manner can be manufactured from plastic or plastic composite material. The floor group 37 can then be separated from the assembly unit 30.1 by breaking through or punching out the separatable area 36. Because the floor group 37 and the assembly unit 30.1 are first formed as a one-piece structure, a filing, smoothing or de-burring procedure need be done only on the free end of the support section 23. Furthermore, the effort needed for re-touching work can be kept to a minimum. Fastening receptacles 34 are used to re-connect the floor group 37 with the assembly unit 30.1, after the separatable area 36 has been broken through or punched out. The fastening receptacles 34 are distributed along the separatable area 36. The floor group 37 is re-connected to the assembly unit 30.1 via a connector 46. For this purpose, the connector 46 includes screw holes, through which fastening screws are passed, so that the connector 46 attaches the floor group 37 to the assembly unit 30.1 via screws being screwed into the fastening receptacles 34. In addition to the fastening receptacles 34, other functional elements 35 are arranged on the floor group 37. The functional elements 35 are integrally formed on the floor group 37 as a one-piece structure. The functional elements 35 project into the intermediate space formed between the floor group 37 and the cooking surface 20. The functional elements 35 are provided with receptacles 35.1. Springs 43 can be attached to these receptacles 35.1. The springs 43 feature a horizontal fastening section 44. The horizontal fastening section 44 may be fixed to the receptacle 35.1 by being fastened thereto with screws. Furthermore, the spring 43 includes a support part 42 that is fastened to the underside of a support tub 41. The support tub 41 serves to receive and house a heating element 40. In a preferred embodiment of the present invention, the support tub 41 includes the circular heating element 40. However, a different embodiment has square or rectangular heating elements 40 embedded in specially built support tubs 41. Depending on the geometry of the support tub 41, a plurality of functional elements 35 are distributed on the floor group 37. Correspondingly, the support tub 41 is also supported by a plurality of springs 43. The springs 43 press or spring-bias the heating element 40 against the underside 22 of the cooking surface 20. A good transfer of heat is assured by this inner contact. An intermediate element 45 is placed under the support tub 41 in order to prevent heat from radiating onto the floor group 37. The intermediate element 45 absorbs or reflects heat radiation. A polished sheet metal piece may be used as an intermediate element 45.

In the present exemplified embodiment, the cooking surface 20 projects over the work plate 10. In order to prevent injury from occurring, the edge of the cooking surface 20 is filed down and an appropriate appearance is achieved by filing down the surfaces all around the filed-down edge of the cooking surface 20 in order to form a beveled surface.

Figure 2:
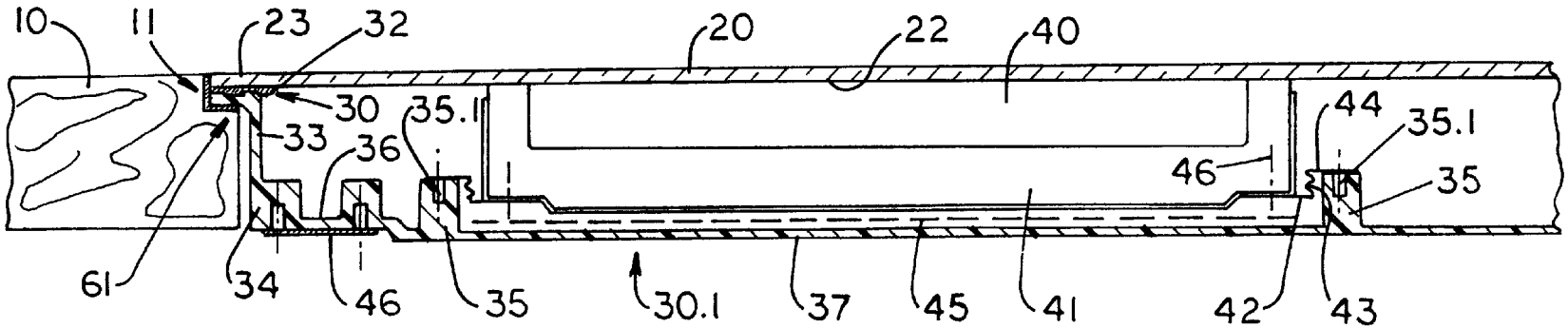
FIG. 2 is a lateral, cross-sectional view of the mounting arrangement of FIG. 1 in a different work plate.

Referring to FIG. 2, a second embodiment of the mounting arrangement of FIG. 1 is shown. In the second embodiment, another cooking surface 20, which is different from the cooking surface of FIG. 1, is fixed to the mounting arrangement. The cooking surface 20 is not provided with a filed-down or beveled edge. In order that cooking surface 20 be flush with the surface of the work plate 10, the receptacle 11 is notched or recessed into the work plate 10 at an appropriate depth. The gap that is formed between the work plate 10 and the cooking surface 20 is filled-in with a mass of silicone.

Figure 3:
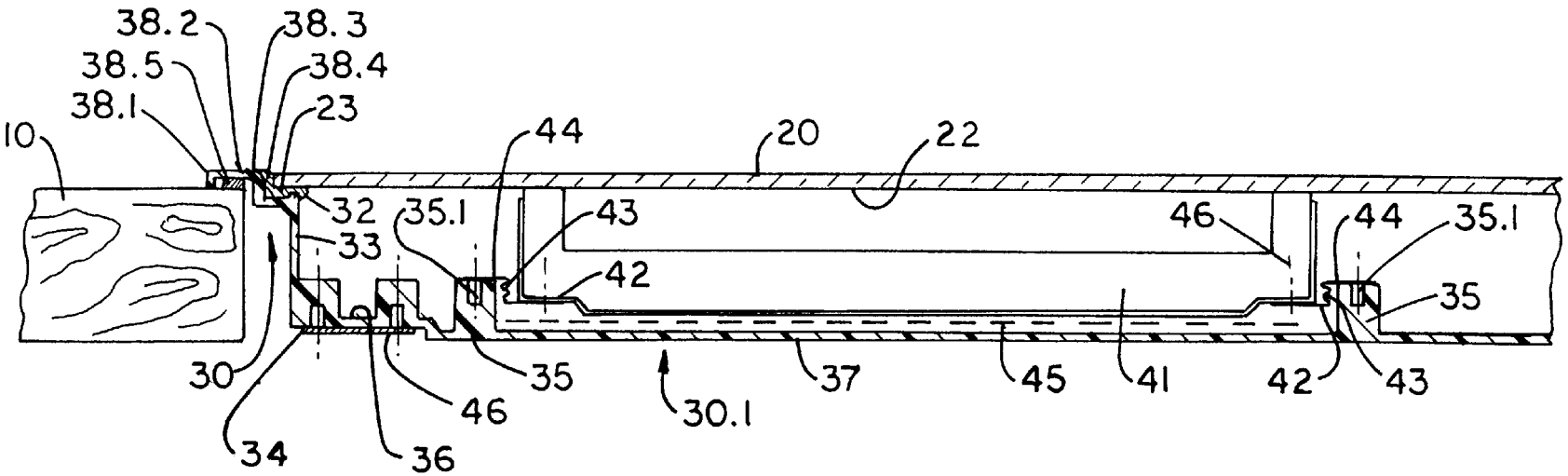
FIG. 3 is a lateral, cross-sectional view of a second embodiment of the mounting arrangement of the present invention for receiving the cooking surface.

Referring to FIG. 3, a third embodiment of a mounting arrangement is illustrated which is different from the first and second embodiments of the mounting arrangement of FIGS. 1 and 2, respectively. The frame unit 30 of the mounting arrangement shown in FIG. 3 includes a vertically extending arm 38.3 connected to the horizontal support section 23. The arm 38.3 includes a horizontally extending visible surface 38.2. The visible surface 38.2 extends to an edge 38.1 which is supported on the work plate 10. The edge 38.1 contacts the work plate 10 so that the visible surface 38.2 is at a distance from the upper surface of the work plate 10. A sealing element 38.5 is placed in the space formed between the bottom surface of the visible surface 38.2 and the edge 38.1. The sealing element 38.5 also serves as the adhesive connection to the surface of the work plate 10. Therefore, an adhering foam adhesive band may be used as the sealing element 38.5. A joint 38.4 is formed between the arm 38.3 and the cooking surface 20 and this joint 38.4 is preferrably filled-in with a mass of silicone. The silicone mass simultaneously also serves as the holding means 32 for fixing the cooking surface 20 to the support section 23.

In FIG. 3, functional elements 35 are shown as the fasteners for the heating elements 40. However, other desired functional elements 35 may be arranged on the floor group 37. For example, other functional elements 35 in the form of cable receptacles, positioning aids or similar can be arranged on the floor group 37.

The sub-assembly formed from the cooking surface 20 and the mounting arrangement can be pre-mounted and placed in the cut-out of the work plate 10. Then, only the electrical connection needs to be carried out.

We claim:

1. A mounting arrangement for a cooking surface, wherein the cooking surface is installed in a cut-out of a work plate using a frame unit that includes a support section for supporting the cooking surface, wherein an assembly unit having a tub-shaped base body and the frame unit are originally, integrally molded to each other as a one-piece structure, and wherein the assembly unit includes functional elements supporting electronic built-in components the mounting arrangement comprising:

a floor group of the tub-shaped base body of the assembly unit, wherein the floor group is originally, disconnectably, integrally molded to the one-piece structure formed from the assembly unit and frame unit; and at least a portion of the functional elements are integrally molded to the floor group.

2. The mounting arrangement according to claim 1, wherein the frame unit and the assembly unit are made of any one of a plastic and a plastic composite material.

3. The mounting arrangement according to claim 2, wherein the electronic built-in components are heating elements, the functional elements support heating elements the arranged beneath the cooking surface and hold the heating elements spaced from both the frame unit and the assembly unit such that an intermediate space is formed between the heating elements and any one of the assembly unit and the frame unit, the intermediate space being for housing any one of a heat absorbing and heat reflecting intermediate element.

4. The mounting arrangement according to claim 3, wherein the functional elements include receptacles for springs and the springs press the heating elements to an underside of the cooking surface.

5. The mounting arrangement according to claim 4, wherein the floor group is originally, disconnectably, integrally connected to the assembly unit via separatable areas that are punched through in order for the floor group to be separated from the assembly unit.

6. The mounting arrangement according to claim 5, wherein fastening receptacles are integrally molded into the assembly unit and the floor group so that connectors can be attached to the fastening receptacles for the floor group to be re-connected to the assembly unit.

7. The mounting arrangement according to claim 6, wherein the assembly unit transitions into a horizontal support section of the frame unit via an upwardly directed, circumscribing wall, the support section being supported in an outward direction on a surface of the work plate different from a surface in which the cut-out is located.

8. The mounting arrangement according to claim 7, wherein the frame unit is adhered to the work plate and the cooking surface is adhered to the frame unit.

9. A method of mounting a cooking surface within a cut-out of a work plate, the method comprising the steps of:

providing a mounting arrangement which includes a frame unit and an assembly unit which are originally, integrally molded as a one-piece structure, wherein the frame unit includes a support section for supporting the cooking surface, wherein the assembly unit has a tub-shaped base body, and wherein the assembly unit includes a floor group which is originally, integrally molded to the one-piece structure of the assembly unit and the frame unit via separatable areas;

providing functional elements, wherein the functional elements include electronic built-in components, and wherein at least a portion of each of the functional elements are integrally molded to the floor group of the assembly unit; and positioning the cooking surface so as to contact the frame unit.

10. The method of claim 9, wherein prior to positioning the cooking surface, a holding means for fixing the cooking surface to the frame unit is applied to the frame unit.

11. The method of claim 9, wherein providing the mounting arrangement includes positioning a portion of the frame unit in a receptacle in an edge of the work plate.

12. The method of claim 11, wherein prior to positioning a portion of the frame unit in the receptacle, an adhesive layer is applied to the receptacle to fix the frame unit to the work plate.

13. The method of claim 9, further comprising punching out the separatable areas to separate the floor group from the assembly unit.

14. The method of claim 13, further comprising re-connecting the floor group to the assembly unit by passing screws through screw holes in a connector in order for the screws to threadingly mate with fastening receptacles.

* * * * *

UNITED STATES PATENT AND TRADEMARK OFFICE

CERTIFICATE OF CORRECTION

PATENT NO. : 6,043,462

DATED : March 28, 2000

INVENTOR(S) : Horst Stedron et al

It is certified that error appears in the above-identified patent and that said Letters Patent is hereby corrected as shown below:

Column 6, line 24, between "support" and "heating", insert --the--;
Column 6, line 25 before "arranged", delete "the".

Signed and Sealed this

Twentieth Day of February, 2001

*Attest:*

Nicholas P. Godici

NICHOLAS P. GODICI

*Attesting Officer*

*Acting Director of the United States Patent and Trademark Office*